US008403713B2

(12) United States Patent
Shamoto

(10) Patent No.: US 8,403,713 B2
(45) Date of Patent: Mar. 26, 2013

(54) CONNECTOR WITH DEDICATED LOCKS AND ENGAGING PORTIONS

(75) Inventor: Wataru Shamoto, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 12/913,168

(22) Filed: Oct. 27, 2010

(65) Prior Publication Data

US 2011/0104951 A1 May 5, 2011

(30) Foreign Application Priority Data

Nov. 4, 2009 (JP) ..... 2009-252857

(51) Int. Cl.
*H01R 13/514* (2006.01)

(52) U.S. Cl. ..... 439/752; 439/701

(58) Field of Classification Search ..... 439/157, 439/595, 680, 701, 752
See application file for complete search history.

(56) References Cited

U.S. PATENT DOCUMENTS 4,596,436 A * 6/1986 Kraemer et al. ..... 439/701
4,997,386 A * 3/1991 Kawachi et al. ..... 439/352
5,729,644 A * 3/1998 Shiflett et al. ..... 385/59
5,879,201 A 3/1999 Fukamachi et al.
5,902,155 A * 5/1999 Polgar et al. ..... 439/680
6,503,108 B1 * 1/2003 Kikuchi et al. ..... 439/680
6,666,728 B2 * 12/2003 Tachi et al. ..... 439/701
6,702,628 B2 * 3/2004 Tanaka et al. ..... 439/752
7,114,998 B2 * 10/2006 Ishikawa et al. ..... 439/752
7,438,568 B2 * 10/2008 Nishide et al. ..... 439/157
7,530,838 B2 * 5/2009 Ohara ..... 439/489
2001/0055918 A1 * 12/2001 Nakamura ..... 439/752

* cited by examiner

*Primary Examiner* — Thanh Tam Le
(74) *Attorney, Agent, or Firm* — Gerald E. Hespos; Michael J. Porco; Matthew T. Hespos

(57) ABSTRACT

A connector is provided with a frame (10) including housing accommodating recesses (11) and auxiliary housings (30) shaped in conformity with the corresponding housing accommodating recesses (11) and to be inserted into the corresponding housing accommodating recesses (11). Locks (34) are formed on outer surfaces of each auxiliary housing (30), and engaging portions (17) for holding the auxiliary housing (30) in the frame (10) by being engaged with the lock portions (34) are formed on inner surfaces of each housing accommodating recess (11). Locks (34A) are shaped so as not to engage the engaging portions (17) formed on the housing accommodating recess (11) when a non-corresponding auxiliary housing (30A) is accommodated into the housing accommodating recess (11).

8 Claims, 8 Drawing Sheets

CONNECTOR WITH DEDICATED LOCKS AND ENGAGING PORTIONS

BACKGROUND OF THE INVENTION

1. Field of the Invention

The invention relates to a connector.

2. Description of the Related Art

U.S. Pat. No. 5,879,201 discloses a conventional divided connector that includes a frame with a plurality of housing accommodating recesses. The divided connector also includes auxiliary housings that are to be accommodated in the respective housing accommodating recesses. The respective housing accommodating recesses are shaped differently to conform to the corresponding auxiliary housings. Locks are formed on an outer surface of each auxiliary housing and engaging portions are formed on an inner surface of each housing accommodating recess. The auxiliary housing is held in the frame by resilient engagement of the locks with the engaging portions. Ribs are formed on outer surfaces of the respective auxiliary housings and are arranged in different manners. Receiving grooves are formed in inner surfaces of the respective housing accommodating recesses and also are arranged in different manners. The ribs fit in the receiving grooves and permit an insertion of the auxiliary housings into the housing accommodating recesses if the respective auxiliary housings correctly correspond to the housing accommodating recesses. However, the ribs cannot fit in the receiving grooves and prevent insertion of the auxiliary housings into the housing accommodating recesses if the respective auxiliary housings do not correspond correctly to the housing accommodating recesses.

The ribs and the receiving grooves prevent erroneous assembly of the auxiliary housings into the frame of the above-described conventional connector. However, a housing accommodating recesses may be larger than or approximately the same size as an auxiliary housing that does not corresponding to this housing accommodating recess. Additionally, the ribs may be at positions to be fit into the receiving grooves. In this situation, the non-corresponding auxiliary housing may erroneously be accommodated into the housing accommodating recess. In such cases, the locks may be at positions to engage the engaging portions, thereby locking the auxiliary housing in the frame. Thus, detachment of the auxiliary housing from the frame is prevented and the erroneously assembled auxiliary housing might remain unnoticed.

The present invention was developed in view of the above situation and an object thereof is to prevent erroneous assembling of auxiliary housings into a frame.

SUMMARY OF THE INVENTION

The invention relates to a connector with a frame that has housing accommodating recesses. The connector also has auxiliary housings shaped substantially in conformity with the corresponding housing accommodating recesses so that the auxiliary housings can be inserted into the corresponding housing accommodating recesses. At least one lock is formed on an outer surface of each auxiliary housing and at least one engaging portion is formed on an inner surface of the corresponding housing accommodating recess. The lock engages the engaging portion to hold the auxiliary housing in the frame. The lock is formed so as not to be engageable with the engaging portion formed on the housing accommodating recess unless the auxiliary housing correctly corresponds to the housing accommodating recess when the auxiliary housing is accommodated into the housing accommodating recess.

The lock cannot engage the engaging portion if the auxiliary housing is accommodated erroneously in the non-corresponding housing accommodating recess. Therefore the auxiliary housing can be detached from the frame to provide reliable detection of an erroneously assembled state of the auxiliary housing.

The lock or the engaging portion preferably is a resiliently deformable arm with a lock hole or recess and the other of the lock or the engaging portion preferably is a lock projection. The auxiliary housing is held in the frame by fitting the lock projection into the lock hole or recess.

The lock projection preferably is formed so as not to fit in the lock hole or recess in the housing accommodating recess unless the auxiliary housing correctly corresponds to the housing accommodating recess. Therefore the erroneously assembled state of the auxiliary housing can be known by a simple construction.

The lock projection preferably is shifted from a proper fitting position into the lock hole or recess in the housing accommodating recess unless the auxiliary housing correctly corresponds to the housing accommodating recess. Thus, significant changes to the existing shapes and arrangements of the lock and the engaging portion are not needed.

The lock projection preferably is larger than the lock hole or recess formed in the housing accommodating recess unless the auxiliary housing correctly corresponds to the housing accommodating recess. Thus, it is sufficient to change the size of the lock projection and not necessary to change the existing shape and arrangement of a part including the lock hole.

The auxiliary housings preferably comprise two locks having different shapes and/or being arranged offset along the height direction with respect to each other.

A restricting projection preferably is formed on the auxiliary housing and can fit into a restricting recess of the frame when inserting the auxiliary housing into the housing accommodating recess.

A projecting distance of the lock preferably is shorter than the projecting distance of the restricting projection.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

A first embodiment of the invention is described with reference to FIGS. 1 to 8. A connector of this embodiment has a frame 10, auxiliary housings 30, a lever 50 and unillustrated terminal fittings. This connector is connectable with an unillustrated mating connector, and the terminal fittings are connected electrically to respective (unillustrated) mating terminal fittings as the two connectors are connected. In the following description, an end of the connector to be connected with the mating connector is referred to as a front end concerning forward and backward directions.

Figure 6:
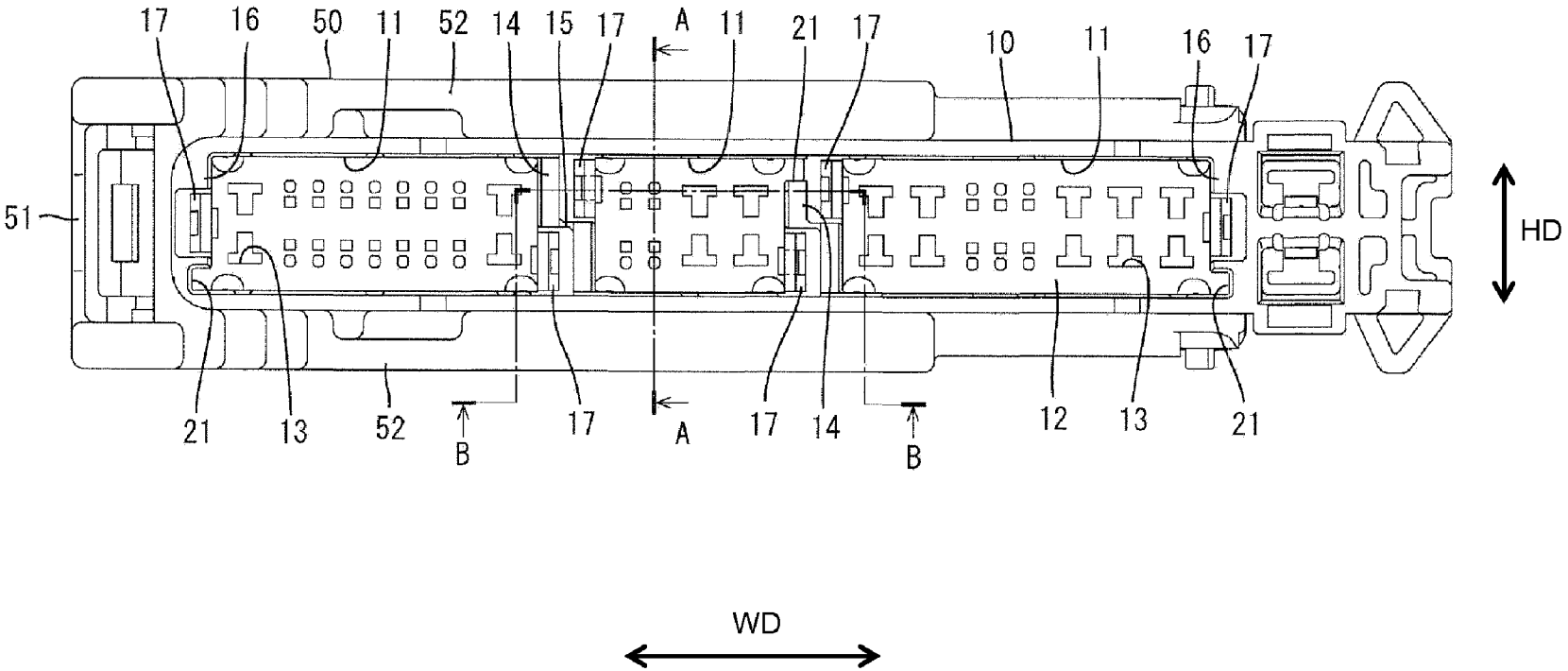
FIG. 6 is a rear view of the frame.

The frame 10 is made e.g. of synthetic resin and is in the form of a rectangular box that is long and narrow in a width direction WD as shown in FIG. 6. Housing accommodating recesses 11 are formed in the frame 10 and are arranged side by side in the width direction WD. The housing accommodating recesses 11 are open in the rear surface of the frame 10, and the front surfaces of the respective housing accommodating recesses 11 are partly closed by a front wall 12 of the frame 10. The front wall 12 has tab insertion openings 13 that can receive tabs of the mating terminal fittings.

The frame 10 also is formed with partition walls 14 that partition between the respective housing accommodating recesses 11 that are adjacent in the width direction WD. A shift portion 15 extending in the width direction WD is formed in a central part of each partition wall 14 in a height direction, and upper and lower portions of each partition wall 14 are shifted in the width direction WD via the shift portion 15.

Figure 7:
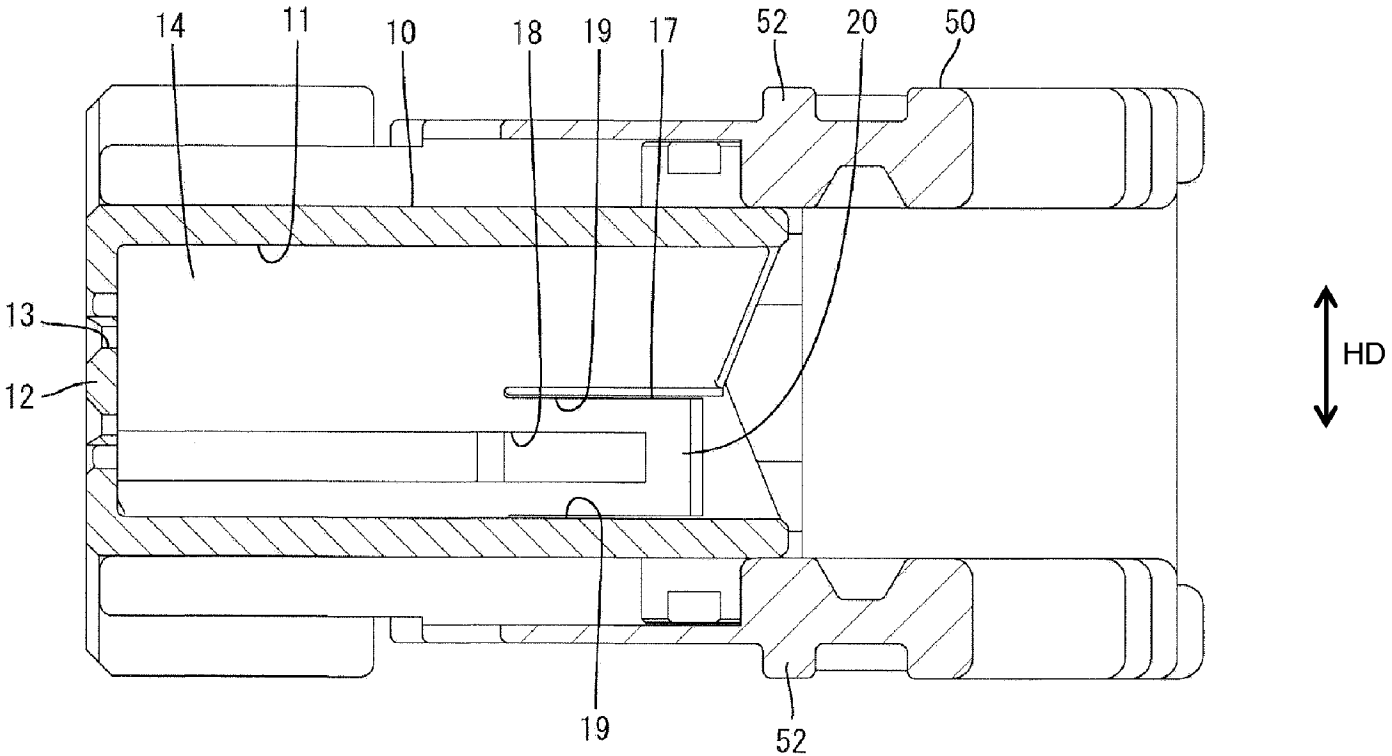
FIG. 7 is a section along A-A of FIG. 6.

Engaging portions 17 are formed on the partition walls 14 and on the end walls 16 in the width direction WD that define the two housing accommodating recesses 11 at the opposite widthwise ends of the frame 10. Two of the engaging portions 17 are formed on the inner surfaces of each of the opposite left and right walls of each housing accommodating recess 11. Specifically, each engaging portion 17 includes a lock groove 18 extending in forward and backward directions and open in the front wall 12 of the frame 10, as shown in FIG. 7, and upper and lower slits 19 extend from an intermediate position of the lock groove 18 in its lengthwise direction, so that the engaging portion 17 is resiliently deformable in and out at the position where these slits 19 are formed. A lock main body 20 which defines the rear end of the lock groove 18 is formed at a rear end of the engaging portion 17.

The engaging portions 17 formed on each partition wall 14 are arranged separately above and/or below the shift portion 15. In other words, the engaging portion 17 of one of the two housing accommodating recesses 11 that are adjacent in the width direction WD is arranged above the shift portion 15 of the partition wall 14 shared by the two housing accommodating recesses 11, and the other engaging portion 17 is arranged below the shift portion 15 of the same partition wall 14. Thus, the upper and lower engaging portions 17 are in a positional relationship to be displaced along the height direction and to overlap each other in the width direction WD, with the two engaging portions 17 being arranged within a thickness range of the partition wall 14 with good space efficiency. On the other hand, the engaging portions 17 formed on the end walls 16 at the opposite widthwise ends particularly are arranged in central parts in the height direction HD.

The end walls 16 at the opposite widthwise ends and the right partition wall 14 in the illustrated example are formed with restricting recesses 21 for preventing erroneous insertion of the auxiliary housings 30 into the housing accommodating recesses 11. The restricting recesses 21 are formed at the bottom ends of the end walls 16 at the opposite widthwise ends and at the upper end of the right partition wall 14. The restricting recess 21 formed in the partition wall 14 substantially faces the upper engaging portion 17 on the same partition wall 14.

The lever 50 is made e.g. of synthetic resin, includes a vertically extending operable portion 51 and two substantially parallel arms 52 projecting from the opposite ends of the operable portion 51 to define a U-shape. The lever 50 is mounted on outer surfaces of the frame 10 and is rotatable between an initial position and a connection position with the arms 52 supported on the opposite upper and lower outer surfaces of the frame 10. The lever 50 is moved from the initial position to the connection position with the connector fit lightly to the mating connector. As a result, a cam action is displayed between the lever 50 and the mating connector to connect the two connectors with a small connecting force.

Figure 1:
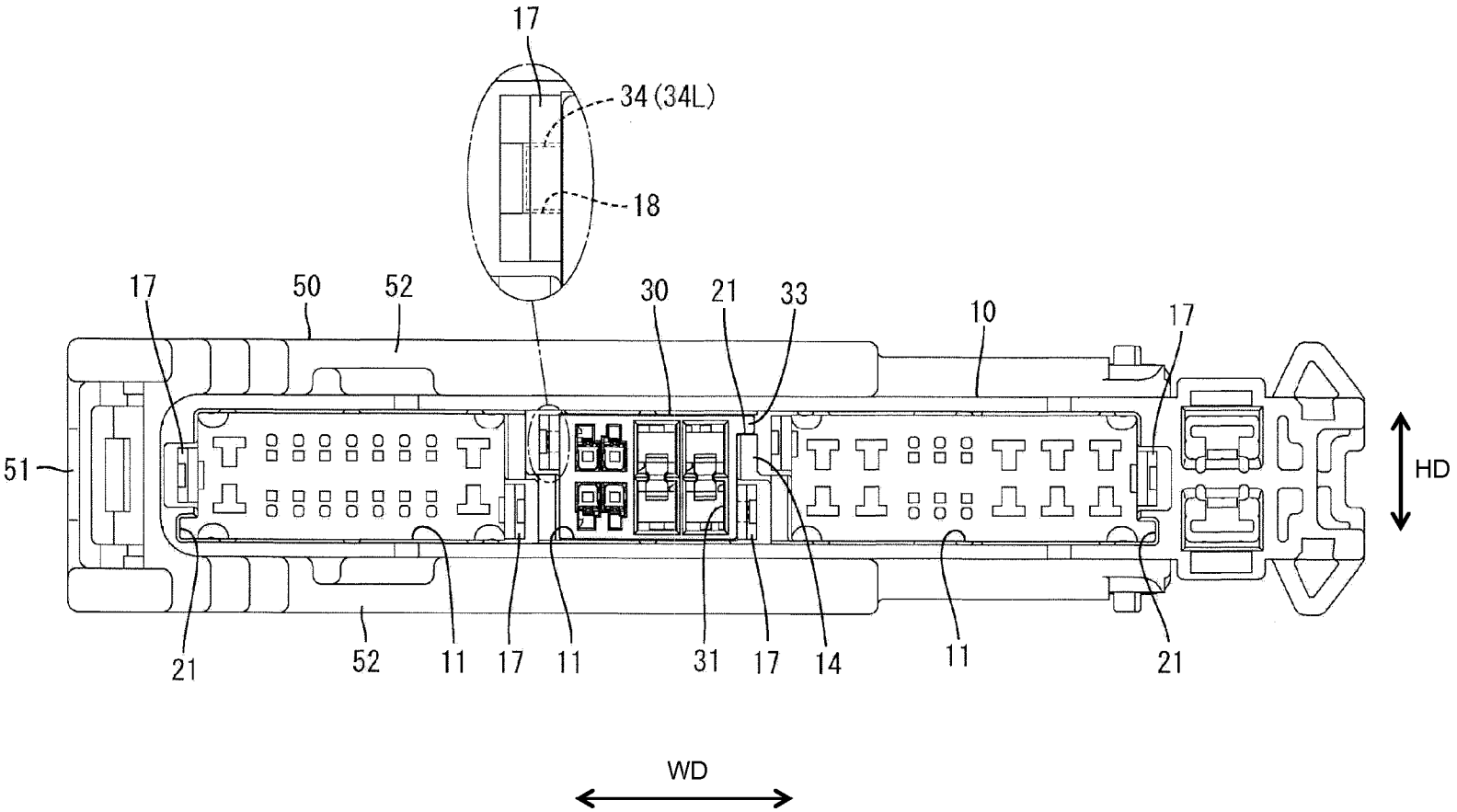
FIG. 1 is a rear view of a connector according to a first embodiment of the invention showing a state where an auxiliary housing is properly inserted in a frame.
Figure 2:
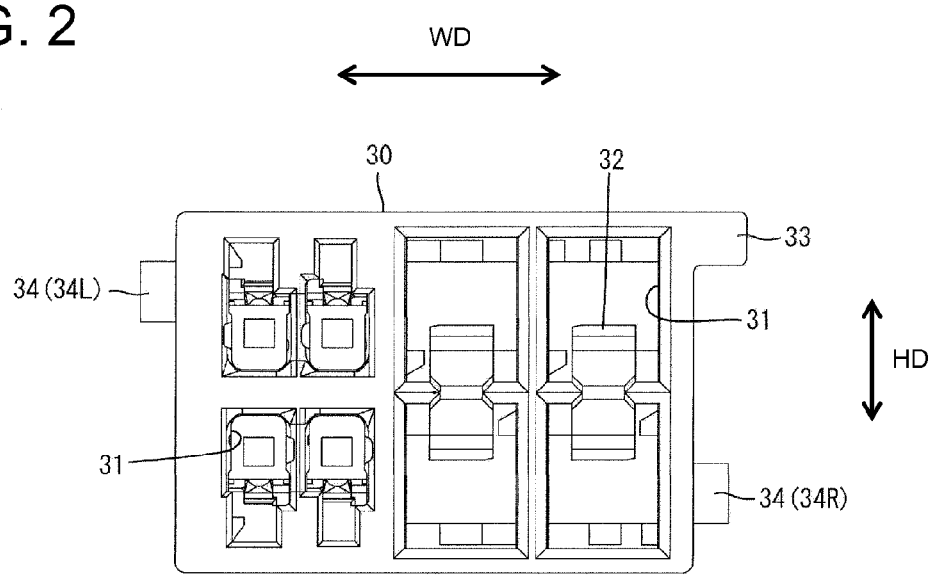
FIG. 2 is a rear view of the properly inserted auxiliary housing.
Figure 3:
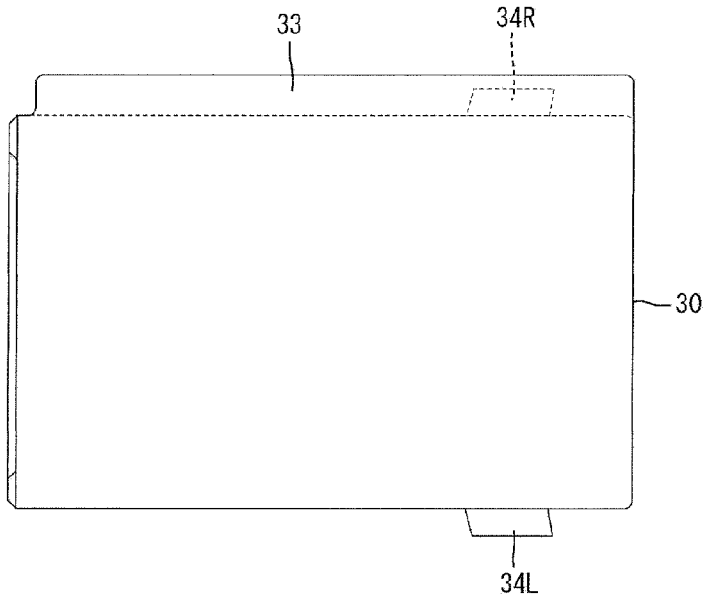
FIG. 3 is a plan view of the properly inserted auxiliary housing.

The auxiliary housings 30 are made e.g. of synthetic resin and define blocks of plural types (e.g. different shapes, different functions, different number of terminal fittings and/or configuration of terminal fittings, etc.) with outer cross-sectional shapes conforming to the corresponding housing accommodating recesses 11. The auxiliary housing 30 shown in FIGS. 2 and 3 is the one to be inserted into the housing accommodating recess 11 located in a widthwise central part of the frame 10, and has fewer poles than the auxiliary housings (not shown) to be inserted into the housing accommodating recesses 11 at the opposite widthwise sides of the middle housing accommodating recess 11. The auxiliary housing 30 has a shape approximate to that of a non-corresponding auxiliary housing 30A shown in FIG. 5 to be inserted into a housing accommodating recess of another frame (not shown).

The auxiliary housing 30 includes cavities 31 for receiving terminal fittings. The cavities 31 are arranged to communicate with the corresponding tab insertion openings 13 in the front wall 12 of the frame 10 at the time of inserting the auxiliary housing 30 into the housing accommodating recess 11. A resiliently deformable locking lance 32 is formed at an inner wall of the each cavity 31 for locking the terminal fittings in the cavities 31.

Figure 8:
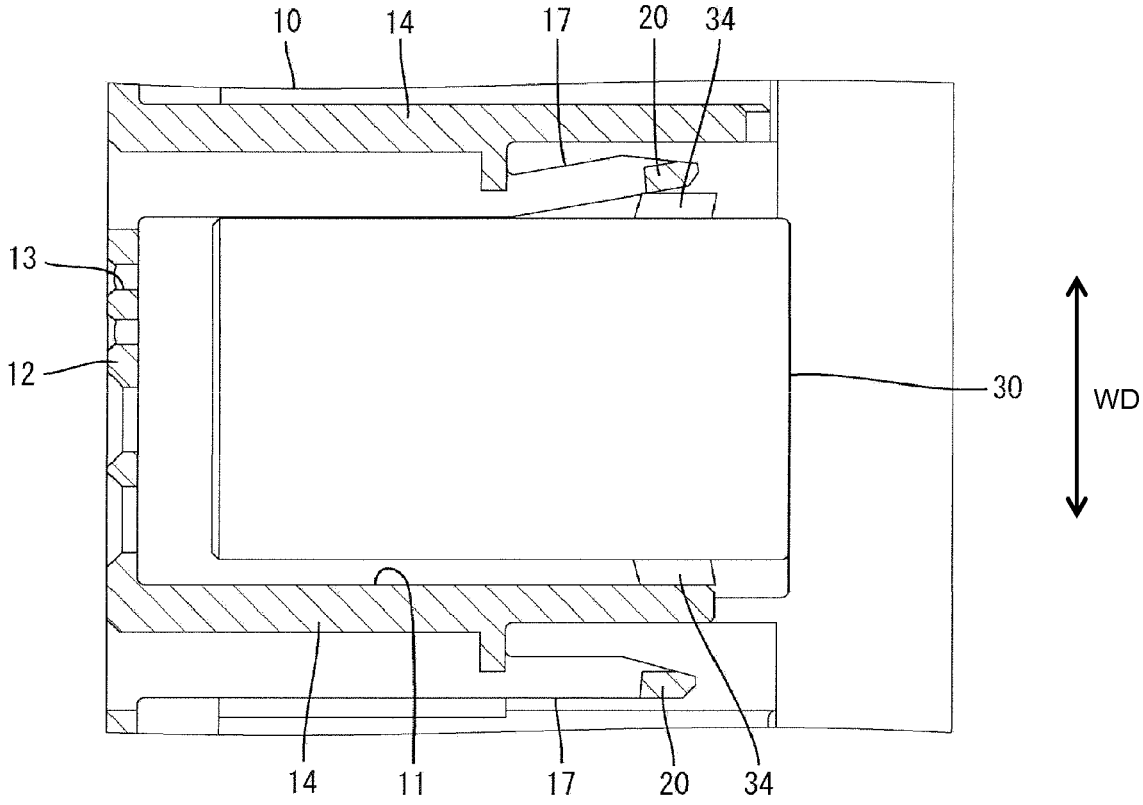
FIG. 8 is a section along B-B of FIG. 6 showing an intermediate state of insertion of the auxiliary housing.

A restricting projection 33 is formed on the right surface of the auxiliary housing 30 in the illustrated example and can fit into the restricting recess 21 when inserting the auxiliary housing 30 into the housing accommodating recess 11. The restricting projection 33 is a rib that extends in forward and backward directions from a position of the upper end of the auxiliary housing 30 near the front end to the rear end. Two locks 34 project from the opposite side surfaces of the auxiliary housing 30. The locks 34 interfere with the lock main bodies 20 in the process of inserting the auxiliary housing 30 into the housing accommodating recess 11 to deform the engaging portions 17 resiliently as shown in FIG. 8. On the other hand, the locks 34 fit into the lock grooves 18 and engage the lock main bodies 20 when the auxiliary housing 30 is inserted properly into the housing accommodating recess 11.

The two locks 34 are shaped identically, but are at different heights along the height direction HD. More particularly, the right lock 34R is arranged in a bottom end portion of the auxiliary housing 30 and the left lock 34L is arranged in an upper end portion of the auxiliary housing 30. A projecting distance of the locks 34 is less than the projecting distance of the restricting projection 33, so that the right lock 34R is hidden behind the restricting projection 33 when the auxiliary housing 30 is viewed from above (see FIG. 3). Both locks 34 have heights and widths to fit into the lock groove 18 of the corresponding engaging portion 17.

On the other hand, the non-corresponding auxiliary housing 30A also has a restricting projection 33A and locks 34A. The left lock 34AL of the non-corresponding auxiliary housing 30A is at an upper part of the side surface of the non-corresponding auxiliary housing 30A similar to the left lock 34L of the auxiliary housing 30. However, the lock 34AL of the non-corresponding auxiliary housing 30A has a height larger than that the lock 34L, i.e. larger than that of the lock groove 18 of the engaging portion 17 formed in the housing accommodating recess 11 into which the auxiliary housing 30 is to be accommodated.

The right lock 34AR of the non-corresponding auxiliary housing 30A has the same shape as the right lock 34R of the auxiliary housing 30, but is at a different height than the lock portion 34R, e.g. in a central part of the side surface of the non-corresponding auxiliary housing 30A in the height direction HD. The restricting projection 33A of the non-corresponding auxiliary housing 30A has the same shape and position as the restricting projection 33 of the auxiliary housing 30. Further, the non-corresponding auxiliary housing 30A is narrower than the auxiliary housing 30. Thus, the non-corresponding auxiliary housing 30A can be inserted to a proper depth into the auxiliary housing 11 corresponding to the auxiliary housing 30 with the right lock 34AR loosely fit.

Each of the unillustrated terminal fittings is formed unitarily by applying bending, folding and/or embossing and other processes to an electrically conductive metal plate. Each terminal fitting has a substantially tubular connecting portion for receiving a tab of the mating terminal fitting and a wire barrel behind the connecting portion to be crimped and connected to an end of a wire.

The auxiliary housing 30 is inserted into the corresponding housing accommodating recess 11 of the frame 10 from behind. When the auxiliary housing 30 is inserted properly into the housing accommodating recess 11, the front surface of the auxiliary housing 30 contacts the front wall 12 of the frame 10 and the locks 34 are fit resiliently into the corresponding lock grooves 18 of the corresponding engaging portions 17 to face the lock main bodies 20 from the front. Thus, the auxiliary housing 30 is retained in the housing accommodating recess 11 (see FIG. 1). At this time, the lock portions 34L, 34R at the opposite widthwise sides reliably fix auxiliary housing 30 in the housing accommodating recess 11. Further, the restricting projection 33 of the auxiliary housing 30 is fit into the restricting recess 21 of the frame 10. In contrast, if the auxiliary housing 30 is in an improper posture (e.g. a vertically inverted), the restricting projection 33 does not conform to the restricting recess 21 and interferes with the rear end of the partition wall 14 to prevent any further insertion of the housing. Thus, the auxiliary housing 30 cannot erroneously be inserted into the housing accommodating recess 11 in the improper (e.g. vertically inverted) posture.

Figure 4:
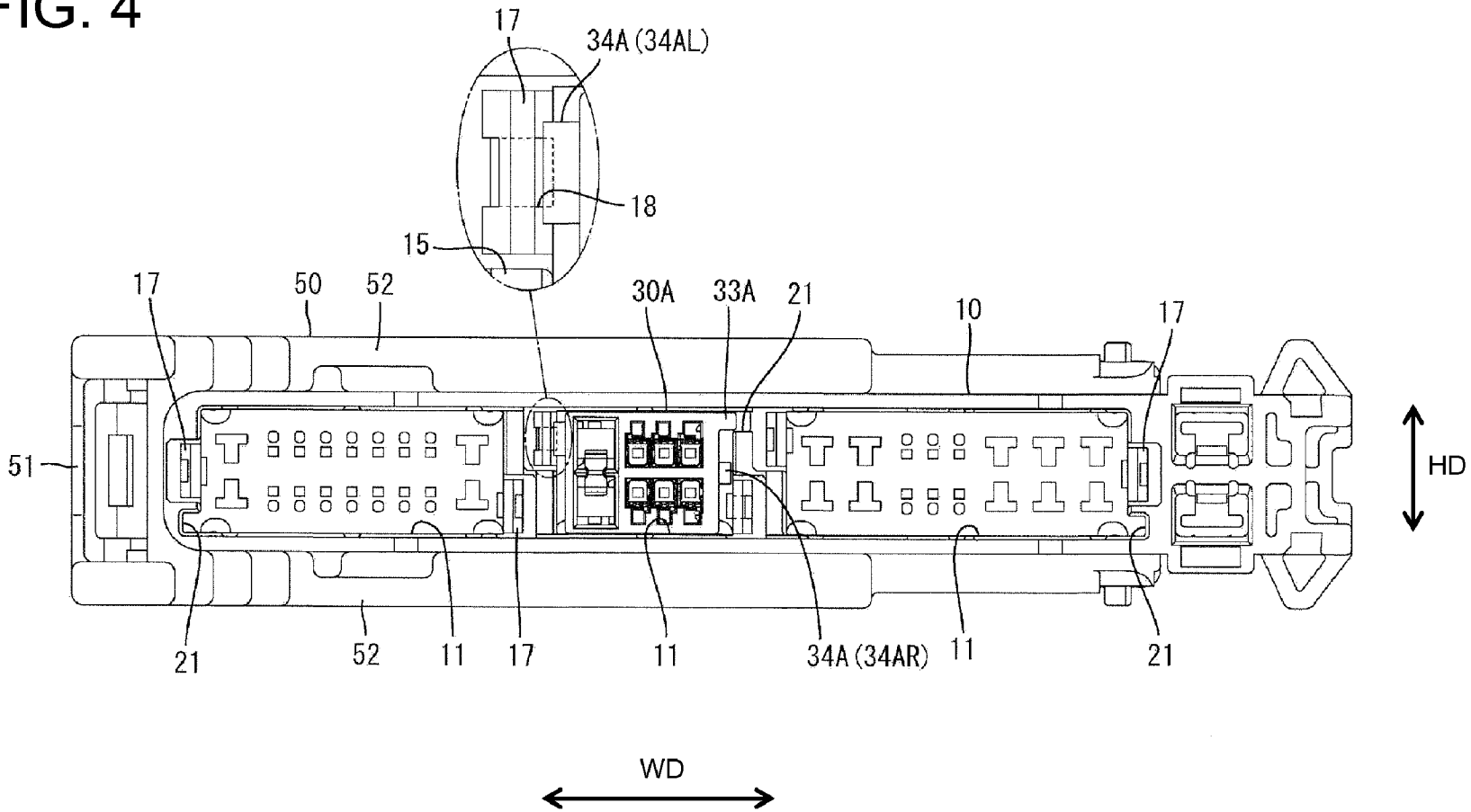
FIG. 4 is a rear view showing a state where an auxiliary housing is erroneously inserted into the frame and cannot be locked.
Figure 5:
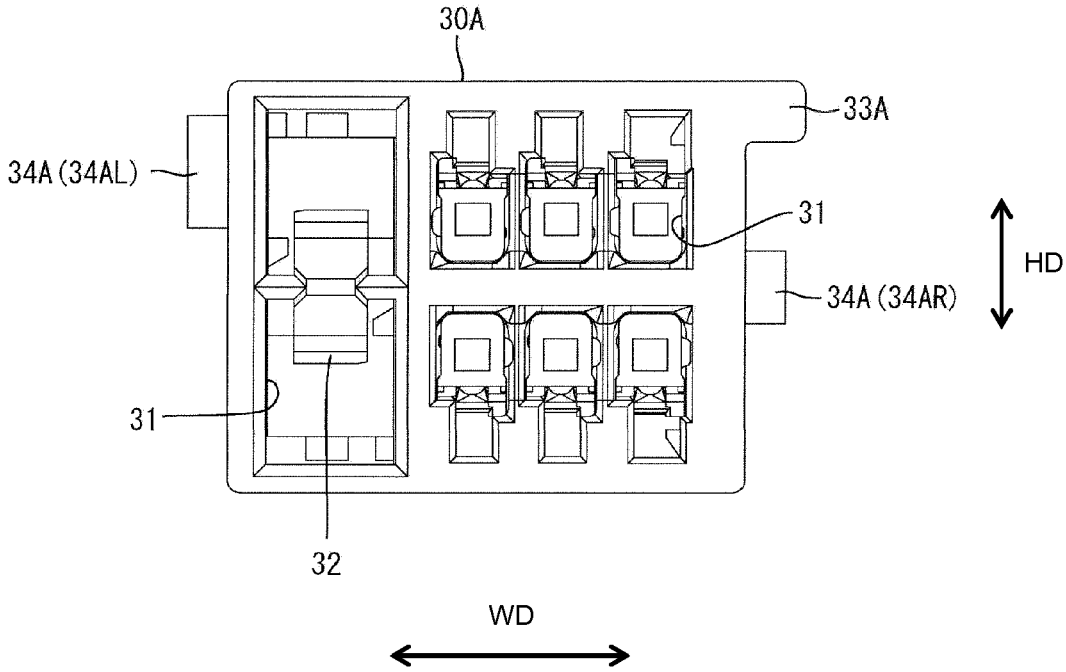
FIG. 5 is a front view of the erroneously inserted auxiliary housing.

The non-corresponding auxiliary housing 30A erroneously could be inserted into the housing accommodating recess 11 of the frame 10 from behind and could reach the proper depth in the housing accommodating recess 11. However, the lock 34AL of the non-corresponding auxiliary housing 30A does not correspond to the lock groove 18, e.g. the height of the lock 34AL of the non-corresponding auxiliary housing 30A is larger than the height of the lock groove 18 of the engaging portion 17, as shown in FIG. 4. Thus, the lock 34AL interferes with and cannot be fit into the lock groove 18 although the lock 34AL interferes with the lock main body 20 to resiliently deform the engaging portion 17. Therefore the lock 34AL and the lock groove 18 do not reach a locked state. Therefore, the non-corresponding auxiliary housing 30A will not remain in the auxiliary housing 11.

Thereafter, the lever 50 is pivoted with the proper auxiliary housings 30 partly inserted in the housing accommodating recesses 11 of the frame 10 so that the connector is connected with the mating connector. The terminal fittings are connected electrically to the mating terminal fittings when the two connectors are connected properly in this way.

As described above, the lock 34AL interferes with the engaging portion 17 if the non-corresponding auxiliary housing 30A is inserted erroneously into the housing accommodating recess 11, but the lock 34AL and the engaging portion 17 are not locked together. Thus, the non-corresponding auxiliary housing 30A can be detached from the frame 10 to avoid erroneously leaving that the non-corresponding auxiliary housing 30A. Therefore, erroneous assembly of the non-corresponding auxiliary housing 30A with the frame 10 is prevented.

Further, the lock 34AL of the non-corresponding auxiliary housing 30A is shaped so as not to fit into the lock groove 18 of the engaging portion 17 corresponding to the lock portion 34L. Thus, an erroneously assembled state of the auxiliary housing 30 can be achieved by a simple construction. Further, in this case, locking cannot be effected since the lock 34AL of the non-corresponding auxiliary housing 30A is larger than the lock groove 18. Therefore, it is sufficient to change only the size of the lock 34AL and not necessary to change the shape and arrangement of the engaging portion 17.

Figure 9:
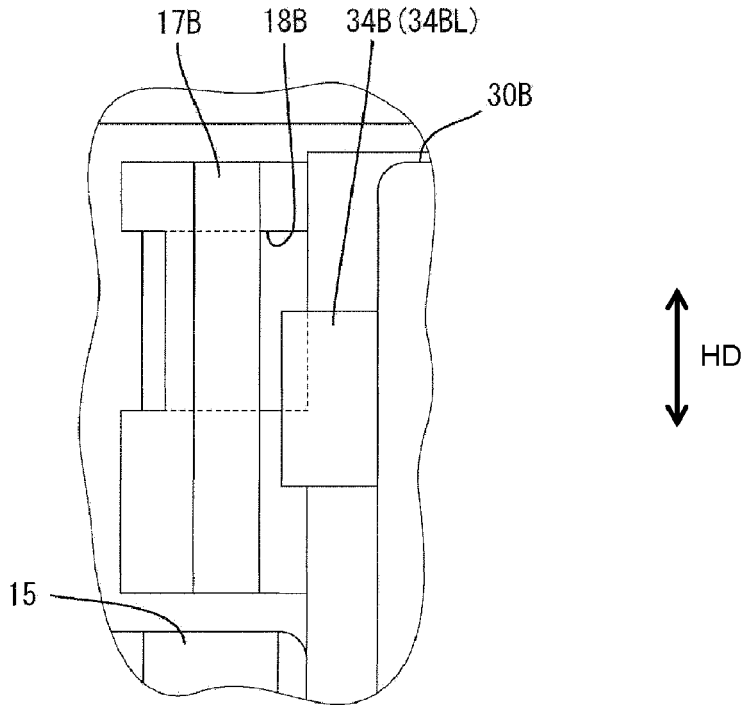
FIG. 9 is an enlarged rear view of an essential part of a connector according to a second embodiment of the invention showing a state where an auxiliary housing is erroneously inserted into a frame and cannot be locked.
Figure 10:
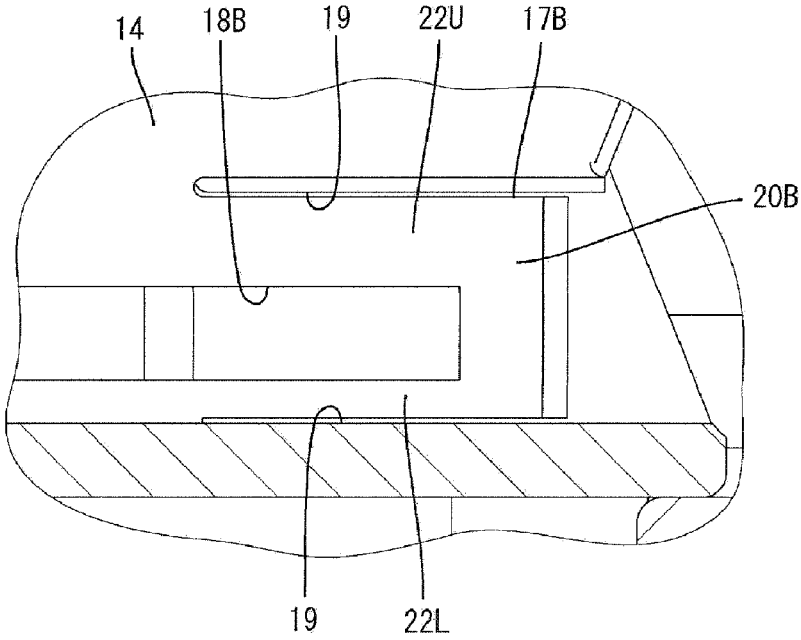
FIG. 10 is an enlarged side view of an essential part of an engaging portion.

FIGS. 9 and 10 show a second embodiment of the invention. The second embodiment differs from the first embodiment in the shape of an engaging portion 17B. Locks 34B of a non-corresponding auxiliary housing 30B have the same shape and arrangement as the locks 34 of the auxiliary housing 30. The other elements are the same as or similar to the first embodiment. These identical or similar elements are identified by the same reference numerals, but are not described again.

The engaging portion 17B of the second embodiment includes a lock groove 18 and a lock main body 20 similar to the first embodiment, but the lock groove 18 is formed at a position different from the first embodiment. In other words, a center of the lock groove 18 in the height direction HD is shifted down from a center of the entire engaging portion 17B in the height direction HD. Thus, an upper arm 22U of two arms 22U, 22L at the opposite upper and lower sides of the lock groove 18B is longer in height than the lower arm 22L.

In this case, the lock 34BL of the non-corresponding auxiliary housing 30B is shifted from a proper fitting position into the lock groove 18B corresponding to the lock 34L. Therefore the lock 34BL cannot fit into the lock groove 18B for locking. According to the second embodiment, it is sufficient to decenter the position of the lock groove 18, and a conventional structure needs not be largely significantly.

The invention is not limited to the above described and illustrated embodiments. For example, the following embodiments also are included in the scope of the invention.

Contrary to the above, the lock may be an arm including a lock groove and the engaging portion may include a lock projection.

Although the locks of the non-corresponding auxiliary housing are shaped to engage the engaging portions corresponding to the auxiliary housing, the locks and the engaging portions may not be locked with each other because they are both shifted.

The locks of the non-corresponding auxiliary housing may not be engageable with the engaging portions by making the locks of the non-corresponding auxiliary housing wider than the engaging portions corresponding to the auxiliary housing.

The invention also is applicable to preventing erroneous assembling of auxiliary housings to be inserted into housing accommodating recesses of the same frame.

The invention is also applicable to connectors not having any lever performing or assisting the connection thereof and/or to connectors having a movable member performing or assisting the connection which is movable along a different path as the above described lever, e.g. having as a movable member a slider being linearly slideable or displaceable to display a cam action.

What is claimed is:

1. A connector, comprising:

a frame including at least first and second housing accommodating recesses, at least one first engaging portion being formed on an inner surface of the first housing accommodating recess and at least one second engaging portion being formed on an inner surface of the second housing accommodating recess; and at least first and second auxiliary housings shaped to conform respectively with the first and second housing accommodating recesses, at least one first lock being formed on an outer surface of the first auxiliary housing and being engageable with the first engaging portion for holding the first auxiliary housing in the first housing accommodating recess of the frame, at least one second lock being formed on an outer surface of the second auxiliary housing and being engageable with the second engaging portion for holding the second auxiliary housing in the second housing accommodating recess of the frame, the locks or the engaging portions being resiliently deformable arms, each of the arms including a lock hole or recess and the other of the locks and the engaging portions being lock projections, the auxiliary housings being held in the frame by fitting the lock projections into the lock holes or recesses, the first lock being formed so as not to be engageable with the second engaging portion if the first housing is inserted inadvertently into the second housing accommodating recess and the second lock being formed so as not to be engageable with the first engaging portion if the second housing is inserted inadvertently into the first housing accommodating recess, thereby preventing the auxiliary housings from being locked inadvertently in a non-corresponding one of the housing accommodating recesses and ensuring engagement of the locks with the respective engaging portions when the auxiliary housings are inserted correctly into the housing accommodating recesses corresponding thereto.

2. The connector of claim 1, wherein the lock projections are formed on the auxiliary housings and the resiliently deformable arms are formed in the housing accommodating recesses, the lock projections being formed so as not to fit into the lock holes or recesses unless the auxiliary housings correctly correspond respectively to the housing accommodating recesses when the auxiliary housings are accommodated into the housing accommodating recesses.

3. The connector of claim 2, wherein the lock projections are shifted from proper fitting positions into the lock holes or recesses formed in the housing accommodating recesses unless the auxiliary housings correctly correspond to the housing accommodating recesses.

4. The connector of claim 2, wherein at least one of the lock projections is larger than at least one of the lock holes or recesses in the respective housing accommodating recess unless the auxiliary housings correctly correspond to the housing accommodating recesses.

5. The connector of claim 1, wherein each of the auxiliary housings has two differently configured locks.

6. The connector of claim 1, wherein each of the auxiliary housings has two locks that are offset along a height direction with respect to each other.

7. The connector of claim 1, wherein a restricting projection is formed on each of the auxiliary housings and can fit into a corresponding restricting recess in each of the housing accommodating recess of the frame only when inserting the auxiliary housings into the correct housing accommodating recesses.

8. The connector of claim 7, wherein a projecting distance of the lock on each auxiliary housing is shorter than a projecting distance of the restricting projection on the respective auxiliary housing.

* * * * *